United States Patent [19]

Hilton

[11] Patent Number: 4,910,977

[45] Date of Patent: Mar. 27, 1990

[54] COOLER FOR CANNED DRINKS

[75] Inventor: Richard J. Hilton, Winnipeg, Canada

[73] Assignee: Daniel Knight, Winnipeg, Manitoba, Canada

[21] Appl. No.: 268,955

[22] Filed: Nov. 9, 1988

[51] Int. Cl.[4] ..... F25D 3/08

[52] U.S. Cl. ..... 62/457.5; 220/93; 220/902

[58] Field of Search ..... 62/457, 371, 372, 457.5; 220/902 X, 93 X

[56] References Cited

U.S. PATENT DOCUMENTS

| | | | |
|---|---|---|---|
| 3,263,806 | 8/1966 | Ring | 220/93 X |
| 3,717,282 | 2/1973 | Nordskog | 221/279 |
| 4,193,525 | 3/1980 | Sommers | 220/902 X |
| 4,516,409 | 5/1985 | Hobbs, Jr. et al. | 62/457 |
| 4,517,815 | 5/1985 | Basso | 62/457 |
| 4,745,776 | 5/1988 | Clark | 62/457 |

*Primary Examiner*—Lloyd L. King

*Attorney, Agent, or Firm*—Adrian D. Battison; Stanley G. Ade; Murray E. Thrift

[57] ABSTRACT

A cooler for drink cans comprises a simple thin walled sleeve of tubular plastics material which is closed at one end and has a removable lid at the other end. The inside dimension of the sleeve is arranged so that it can receive a number of cans in stacked axially along the sleeve in end to end relationship biased by a spring presenting the cans gently one at a time at the upper end of the sleeve for removal. Between each can and the next adjacent can is a disc shaped body formed by a molded plastic defining a hollow interior for a refrigerant material. The discs have domed surfaces to improve contact with the adjacent cans. The discs can be readily stored within a freezer for charging of the refrigerant. The narrow dimensions of the sleeve enable it to be readily stored within a golf bag.

5 Claims, 2 Drawing Sheets

COOLER FOR CANNED DRINKS

BACKGROUND OF THE INVENTION

This invention relates to a cooler for canned drinks of a type which enables the drinks to be readily carried, maintained in a cool condition and readily removed from the container while any remaining drinks are maintained cooled.

Various containers for drinks have been provided and to enable storage of the drinks in a convenient container of minimum dimension, for example in a golf bag, the container is in many cases shaped as a cylindrical sleeve with the drinks in canned or bottled form stacked axially along the length of the container.

Examples of this type of container are shown in U.S. Pat. Nos. 3,717,282 (Nordskog), 4,516,409 (Hobbes), 3,263,806 (Ring) and 4,193,525.

The Nordskog patent relates to a container of this sort which includes a spring forcing the cans upwardly toward one end of the container together with a latching arrangement which releases one can at a time. The device however has no provision for cooling of the drinks or for maintaining the drinks in a cooled condition.

Ring discloses an arrangement in which the cylindrical container includes a peripheral wall the major portion of the thickness of which is made up of an insulating material such as expanded polystyrene beads. Such a container is however relatively bulky, complex and expensive to manufacture and merely relies on an insulating effect to maintain the drinks in a cooled condition.

Hobbs discloses a cylindrical container which is specially molded and formed so as to define spaced parallel walls of the container. Such a container is again extremely expensive to manufacture in view of the very large and complex molding arrangements which are necessary and hence cannot be made available at a low cost. Hobbs mentions that chambers can be defined in the wall of the container by a generally cylindrical inner side wall and an outer side wall with a refrigerant being inserted into the chamber. It further states that one more of the container sections can be placed in a conventional refrigerator to reduce the temperature of the refrigerant material.

This device therefore applies an additional cooling effect to the contained drinks but requires a highly complex part to be manufactured and in addition the part is relatively large in size when inserted into the freezer for cooling.

SUMMARY OF THE INVENTION

It is one object of the present invention, therefore, to provide an improved container for drinks which enables the drinks to receive a cooling effect while stored and is of a type which can be manufactured cheaply and simply to enable the device to be sold at relatively low cost.

According to the invention, therefore, there is provided a cooler device for canned drinks comprising an elongate cylindrical sleeve having two opposed ends and a cylindrical wall dimensioned to receive in end to end relationship along the length of the sleeve a plurality of stacked drink cans with the cans confined against side to side movement by an inner surface of the wall, means closing one end of the sleeve, a lid on the other end of the sleeve so as to confine the cans within the sleeve when in place on the sleeve and removable therefrom to allow removal of the cans one at a time from the other end of the sleeve, and a plurality of discs each being formed from upper and lower surfaces and a peripheral wall connecting the upper and lower surfaces which are spaced to define a hollow closed area therebetween containing a refrigerant material, the peripheral wall having a diameter substantially equal to that of a can such that it can be received within the sleeve between one can and a next adjacent can with the upper surface in contact with one can and the lower surface in contact with the next adjacent can to provide a cooling action thereon.

Preferably, therefore the device is a simple sleeve of extruded plastics material which is very inexpensive, a pair of end plugs one of which can be welded into place to define a closed end of the sleeve and one of which is simply a press fit within the sleeve, and a plurality of discs.

The discs are relatively inexpensive to manufacture since they are a relatively small molded part requiring little plastics material. In addition the discs can be readily stored within the freezer until used since they take up little room. Furthermore the discs can be replaced into the container after a can is removed so that discs remaining within the container apply a continuing cooling effect to the remaining cans.

The device is particularly useful in a golf bag since it is cylindrical in form and thus can be readily inserted along the length of the golf bag alongside the clubs.

Preferably the device includes a spring engaging the closed end which biases the cans and discs upwardly toward the open end so that each can can be removed in turn and when removed enables the next can to be presented at the open end for removal. Thus when a can is removed, the disc on top of that can can be replaced into the container and the lid reclosed. When the lid is again removed, both the disc and the next disc followed by the next can will be presented so that the can can be removed and the discs replaced.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
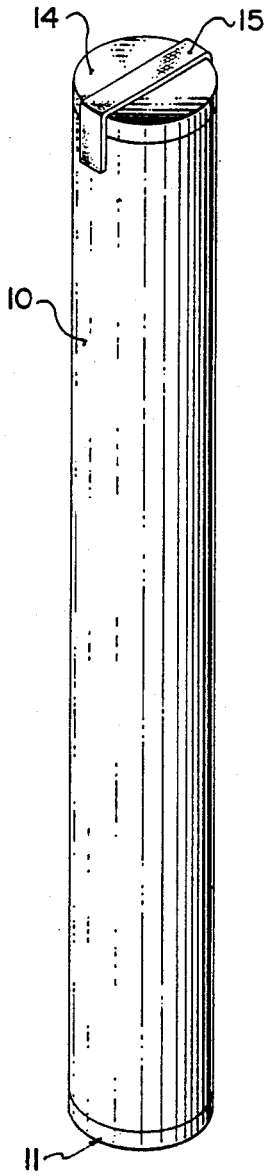
FIG. 1 is an isometric view of a drink can cooler according to the invention.

The cooler comprises a tubular sleeve 10 formed simply of an extruded plastics material which is sufficiently rigid to maintain its shape under its own weight but has a thin wall thus enabling it to be manufactured cheaply and simply. The thin wall enables the tubular sleeve to be formed in substantially minimum dimension since it is basically free from additional insulating material such as foam material or a cavity wall construction.

The diameter of the tubular sleeve 10 is such that it can receive on an inner surface the outside surface of a conventional drink can with a slight clearance sufficient to enable the can to slide along the inner surface without substantial resistance with the clearance being sufficiently small that the cans are confined to lie axially along the inside of the tubular sleeve.

A lower end of the tubular sleeve is closed by an end plug 11 which includes a portion 12 projecting into the inner surface of the sleeve 10 and is attached to the sleeve by welding around the contact line 13. An upper removable lid 14 comprises a plug member substantially the same as the lower end 11 but in this case the plug member is free to be removed simply by pulling from the end of the tubular sleeve. The plug or lid can be held in place by a strap 15 attached to the plug and releasably attachable to the outer surface of the tubular sleeve 10 by way of suitable fastening means 16 which may be of the hook and loop fastener type or maybe of the press fastener type.

The tubular sleeve 10 and its upper and lower closures 11 and 14 can therefore simply be manufactured from substantially readily available parts.

A lightweight coil spring 17 is mounted within the tubular sleeve so as to engage the upper surface of the lower plug 11 and to stand upwardly therefrom. In a relaxed condition the spring is arranged to have a length substantially equal to the length of the sleeve 10 but in addition the spring can be compressed down to a small height of the order of 2 to 3 inches as the sleeve is filled with cans. As the spring has a resistance force substantially proportional to its amount of compression, it applies to a can at the upper end substantially the same force whether there be only one can in the sleeve or whether the sleeve is substantially filled with cans down to the full compression extent of the spring. In this way each can in turn is presented gently at the open mouth of the sleeve when the lid 14 is removed so that the can can be pulled from the sleeve and the lid replaced. When the lid is again removed, the next can is again gently presented at the opening for removal by the user.

Between each can and the next adjacent can is provided a disc 18. The disc 18 shown in more detail in FIGS. 3 and 4 includes an outer cylindrical peripheral wall 19, an upper surface 20 and a lower surface 21. The diameter of the peripheral wall 19 is such that it is just received within the inner surface of the sleeve 10 as substantially a sliding fit so the disc when deposited into the sleeve lies transverse to the sleeve with the peripheral wall adjacent to the inner surface of the sleeve.

Figure 2:
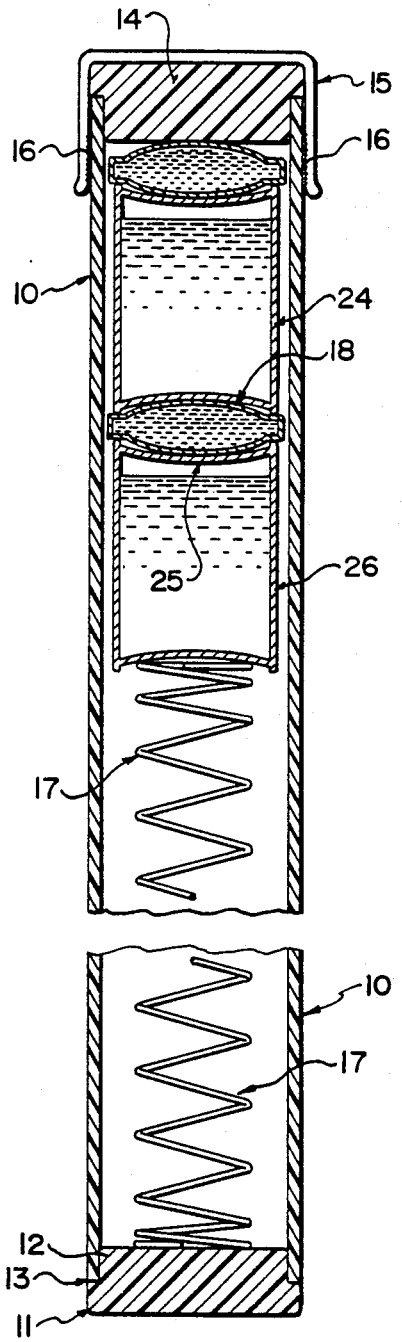
FIG. 2 is a longitudinal cross sectional view of the cooler of FIG. 1 on an enlarged scale.
Figure 3:
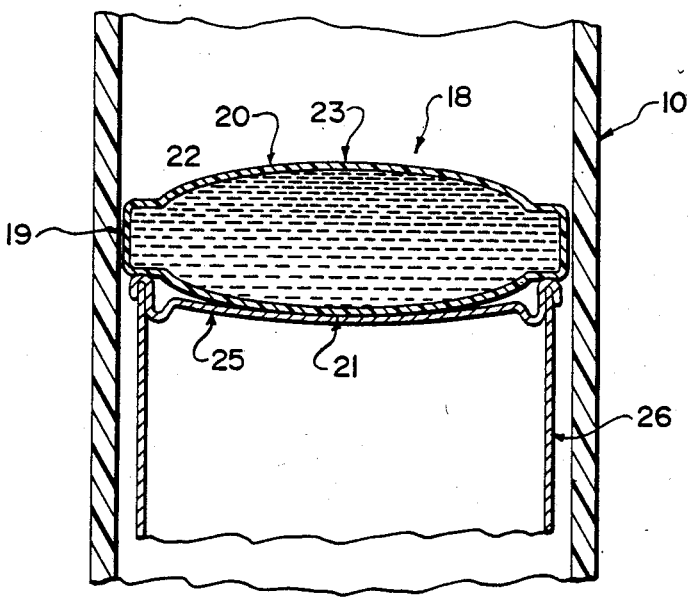
FIG. 3 is a cross sectional view similar to that of FIG. 2 on a yet further increased scale showing the details of one disc.
Figure 4:
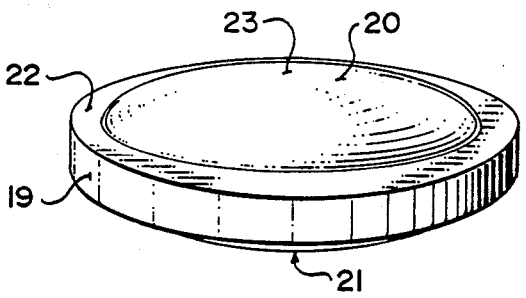
FIG. 4 is an isometric view of a single disc of the cooler of FIG. 1.

Both the upper and lower surfaces 20 and 21 include an outer edge 22 which lies in a radial plane together with a domed portion 23 which is convex and extends outwardly from the upper surface. As shown in FIGS. 2 and 3, the domed surface enables the disc to lie more closely in contact with the concavely domed undersurface of a can indicated at 24 and also in contact with the recessed upper surface 25 of a lower can 26.

The discs are formed by molding from a thin plastics material defining a hollow interior. The hollow interior is filled with a suitable refrigerant material such as propylene-glycol. The discs have a diameter of the order of 3 inches and a height of the order of 0.75 to 1.0 inches and hence are relatively small enabling them to be readily removed from the sleeve and carried separately or contained separately within a freezer.

The manufacture of the sleeve from a thin material enables it to be readily received within a golf bag and the length of the sleeve is arranged to be of the order of the length of the golf bag so that the bottom of the sleeve rests against the bottom of the golf bag and the lid is readily available at the open mouth of the golf bag for removal and access to the cans.

When a can is removed from the sleeve, the disc adjacent to that can can be returned to the sleeve and the lid replaced so that the coolant within the disc can continue to act upon the remaining cans.

When the cans are all consumed and removed, the discs can themselves be removed simply from the sleeve without the necessity of removing the sleeve from the golf bag. The discs can then be placed in a freezer for recharging of the coolant.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A cooler device for canned drinks comprising an elongate cylindrical sleeve having two opposed ends and a cylindrical wall consisting of single layer of an extruded plastics material which is free from foamed insulating material and having a length to receive in end to end relationship along the length of the sleeve a plurality of stacked drink cans and having a diameter relative to the diameter of a conventional can that the can is confined against side to side movement by an inner surface of the all and there is a clearance between the can and the inner surface of the wall, means closing one end of the sleeve, a lid on the other end of the sleeve so as to confine the cans within the sleeve when in place on the sleeve and removable therefrom to allow removal of the cans one at a time from the other end of the sleeve, a plurality of discs each being formed from upper and lower surfaces and a peripheral wall connecting the upper and lower surfaces which are spaced to define a hollow closed area therebetween containing a refrigerant material, the peripheral wall having a diameter substantially equal to that of a can such that it can be received within the sleeve between one can and a next adjacent can with the upper surface in contact with one can and the lower surface in contact with the next adjacent can to provide a cooling action thereon and a spring engaging said closing means and arranged to bias said plurality of stacked cans away from said one end of the sleeve toward the other end of the sleeve such that the cans are presented one at a time at said other end for removal from the sleeve.

2. The invention according to claim 1 wherein the lid comprises a plug member insertable as a press fit into said other end of the sleeve.

3. The invention according to claim 1 wherein at least one of said upper and lower surfaces of the disc is shaped to form a convex dome for engaging a concave underside of the can.

4. The invention according to claim 3 wherein said at least one surface of the disc includes a flat edge portion surrounding the convex dome.

5. The invention according to claim 1 wherein the disc has a thickness less than 1 inch.

* * * * *